US006422938B1

(12) United States Patent
Steitz

(10) Patent No.: US 6,422,938 B1
(45) Date of Patent: Jul. 23, 2002

(54) PRESSURE SEAL C-Z FOLD

(75) Inventor: Jeremy W. Steitz, Cedar Rapids, IA (US)

(73) Assignee: Moore North America, Inc., Stamford, CT (US)

( * ) Notice: Subject to any disclaimer, the term of this patent is extended or adjusted under 35 U.S.C. 154(b) by 0 days.

(21) Appl. No.: 09/482,875

(22) Filed: Jan. 14, 2000

(51) Int. Cl.[7] ..... B65D 27/04; B65D 27/06; B65D 27/34

(52) U.S. Cl. ..... 462/18; 229/92.1; 229/92.3; 283/56; 283/57; 283/58; 283/61; 283/62; 283/66.1; 283/66.2; 283/101; 283/103; 283/105; 283/116; 462/8; 462/18; 462/25; 462/26; 462/45; 462/53; 462/64; 462/68; 462/70; 462/900; 462/903

(58) Field of Search ..... 283/56, 57, 58, 283/61, 62, 66.1, 66.2, 101, 103, 105, 116; 462/8, 25, 26, 45, 53, 64, 68, 70, 900, 903, 18; 229/92.1, 92.3

(56) References Cited

U.S. PATENT DOCUMENTS 4,575,121 A 3/1986 Conti
4,585,160 A 4/1986 Fiske (List continued on next page.)

FOREIGN PATENT DOCUMENTS

WO WO 92 224 31 12/1992

OTHER PUBLICATIONS

Standard Register Corporation Jury Form for New Jersey, Admitted Prior Art.

*Primary Examiner*—A. L. Wellington
*Assistant Examiner*—Mark T. Henderson
(74) *Attorney, Agent, or Firm*—Nixon & Vanderhye PC

(57) ABSTRACT

A mailer type business form intermediate, and method of producing a mailer from the intermediate, effect folding in a novel manner in order to produce a business form that is particularly advantageous for providing a negotiable instrument, such as a bank check or money order. The intermediate has conventional components, but with first, second and third fold lines defining a sheet of paper comprising the intermediate into first through fourth panels. The fourth panel has indicia defining the negotiable instrument and at least one line of weakness separating the negotiable instrument from the rest of the fourth panel. Tacking adhesive patterns may be disposed substantially parallel to the top and bottom edges of the intermediate to hold the first panel second face to the second panel second face adjacent the top edge and second fold line, and to hold the fourth panel second face to the second panel first face adjacent the first and third fold lines, when the intermediate is folded about the fold lines. To make the final mailer the fourth panel is folded about the third fold line so that the first face of the fourth panel comes into operative contact with the first face of the third panel, and then the first and second panels are Z-folded about the first and second fold lines to bring the second panel first face into operative contact with the fourth panel second face and the first panel second face into operative contact with the second panel second face. Preferably the adhesive for holding the mailer together comprises pressure activated cohesive, and a pressure of at least 100 pounds per lineal inch is applied to the folded intermediate to form the sealed mailer.

14 Claims, 6 Drawing Sheets

U.S. PATENT DOCUMENTS 4,799,618 A 1/1989 Jenkins
4,918,128 A 4/1990 Sakai
5,174,491 A 12/1992 Taylor et al.
5,201,464 A 4/1993 File
5,253,798 A 10/1993 Lombardo
5,314,110 A 5/1994 Lombardo
5,346,123 A * 9/1994 Lombardo ..... 229/92.1
5,366,145 A 11/1994 Sauerwine
5,402,934 A 4/1995 Sauerwine
5,513,795 A 5/1996 Sauerwine
5,553,774 A 9/1996 Goodno
5,598,970 A * 2/1997 Mudry et al. ..... 229/92.1
5,622,390 A * 4/1997 Jenkins ..... 283/56
5,759,327 A * 6/1998 Chang ..... 229/80
5,785,242 A 7/1998 Lombardo
5,829,670 A 11/1998 Lombardo et al.
5,829,870 A * 11/1998 Lombardo et al. ..... 229/92.1
6,123,255 A * 9/2000 Chimera ..... 229/305
6,196,453 B1 * 3/2001 Hutchinson ..... 229/92.1
6,235,139 B1 * 5/2001 Vichinsky, Jr. et al. .... 229/92.1
6,290,634 B1 * 9/2001 Lombardo et al. ..... 493/188

* cited by examiner

PRESSURE SEAL C-Z FOLD

BACKGROUND AND SUMMARY OF THE INVENTION

The invention relates to improvements in an intermediate for a mailer type business form, the mailer so produced, and a method of manufacture thereof, which have advantages under a number of circumstances. The invention is particularly useful in association with negotiable instruments, such as bank checks, money orders, bearer bonds, and the like, which often can be seen through conventional mailer type business forms. There is a need for a business form in association with a negotiable instrument which can provide the necessary level of confidentiality so that there is no show through in the final mailer, and also one that can be simplex printed, is postal compatible, and gives the user of the intermediate more than enough room to print any desired information.

According to the present invention the above goals are accomplished by utilizing a four ply mailer type business form which can have the outgoing address and payee and amount information for a negotiable instrument simplex printed on the first face of the intermediate. The intermediate is provided with three fold lines, and folding takes place in an unusual manner. Rather than providing a standard double fold construction such as is shown in U.S. Pat. Nos. 5,314,110 and 4,575,121, the negotiable instrument is V-folded so that the negotiable instrument is "inside" the mailer to be formed, and the first and second panels are Z-folded to produce a final mailer.

According to one aspect of the present invention a mailer type business form intermediate is provided comprising the following components: A substantially quadrate cut sheet of paper having first and second faces, top and bottom edges substantially parallel to each other, and first and second side edges substantially perpendicular to the top and bottom edges and substantially parallel to each other. The top and bottom edges spaced a first distance, and the side edges spaced a second distance, less than the first distance. First and second lines of weakness formed in the sheet adjacent, but spaced from and substantially parallel to, the first and second side edges, respectively, to define first and second removable side margin portions. First, second and third fold lines formed in the sheet substantially parallel to the top and bottom edges, and defining the sheet into first, second, third and fourth panels, the first panel between the top edge and the first fold line, the second panel between the first and second fold lines, the third panel between the second and third fold lines, and the fourth panel between the bottom edge and the third fold line. At least one pattern of adhesive in the side margins on both of the faces, the patterns for holding the sheet in a folded configuration as a mailer. And the fourth panel comprising indicia defining a negotiable instrument.

Preferably the at least one pattern of adhesive comprises pressure activated cohesive pattern elements in the removable side margin portions of the first face of the second, third and fourth panels, and the second face of the first, second and fourth panels. The pressure activated cohesive pattern elements in the removable side margin portions of the first face of the second, third and fourth panels, and the second face of the first, second and fourth panels, is preferably such as disclosed in U.S. Pat. Nos. 4,918,128 and 5,201,464, and is sealed by using conventional sealers which apply a force of at least about 100 pounds per lineal inch (e.g. at least about 200 pounds per lineal inch).

The negotiable instrument defining indicia may be provided on both the first and second faces of the fourth panel. The indicia includes payee and amount indicia on the first face of the fourth panel, typically the payee of the bank check and the amount of the check, although also possible are bearer bond indicia, or money order indicia, and the amounts thereof. Typically outgoing addressee indicia, corresponding at least in part to the payee indicia (such as the name of the payee/addressee) is imaged on the first panel first face.

The intermediate also preferably comprises tacking adhesive patterns disposed substantially parallel to the top and bottom edges and positioned to hold the first panel second face to the second panel second face adjacent the top edge and the second fold line, and to hold the fourth panel second face to the second panel first face adjacent the first and third fold lines. Also preferably, but not necessarily, the panels are of substantially the same size. The at least one line of weakness separating the negotiable instrument from the rest of the fourth panel preferably comprises a line of weakness (such as a perforation line) on the opposite side of tacking adhesive on the fourth panel second face from the third fold line. Preferably the first, second and third fold lines are lines of weakness; and the distance between the top and bottom edges is about 14 inches; and the distance between the side edges is about 8½ inches.

In order to minimize or substantially preclude any possibility of "see through" or "show through" the intermediate preferably comprises security screening on the third panel second face, and on at least one of (and preferably both of) the first and second panel second faces.

According to another aspect of the present invention a mailer type business form intermediate is provided comprising the following elements: A substantially quadrate cut sheet of paper having first and second faces, top and bottom edges substantially parallel to each other, and first and second side edges substantially perpendicular to the top and bottom edges and substantially parallel to each other. The top and bottom edges spaced a first distance, and the side edges spaced a second distance, less than the first distance. First and second lines of weakness formed in the sheet adjacent, but spaced from and substantially parallel to, the first and second side edges, respectively, to define first and second removable side margin portions. First, second and third fold lines formed in the sheet substantially parallel to the top and bottom edges, and defining the sheet into first, second, third and fourth panels, the first panel between the top edge and the first fold line, the second panel between the first and second fold lines, the third panel between the second and third fold lines, and the fourth panel between the bottom edge and the third fold line. At least one pattern of adhesive in the side margins on both of the faces, the patterns for holding the sheet in a folded configuration as a mailer. And tacking adhesive patterns disposed substantially parallel to the top and bottom edges and positioned to hold the first panel second face to the second panel second face adjacent the top edge and the second fold line, and to hold the fourth panel second face to the second panel first face adjacent the first and third fold lines, when the intermediate is folded about the fold lines.

Preferably the tacking adhesive comprises widely spaced elements of pressure activated cohesive, including provided on the fourth panel second face adjacent the third fold line. Then preferably a line of weakness (such as a perforation line) is provided in the fourth panel substantially parallel to the third fold line and on the opposite side of the elements from the third fold line. The intermediate also preferably further comprises outgoing addressee indicia imaged on the first panel first face, and security screening on the first, second, and third panel second faces; and the at least one pattern of adhesive preferably comprises pressure activated cohesive pattern elements in the removable side margin portions of the first face of the second, third, and fourth panels, and the second face of the first, second and fourth panels.

The invention also relates to the method of handling an intermediate such as described in any of the preceding descriptions, comprising the steps of: (a) imaging at least some common variable indicia on the first faces of at least the first and fourth panels, including outgoing addressee indicia on the first panel first face; (b) folding the fourth panel about the third fold line so that the first face of the fourth panel comes into operative contact with the first face of the third panel, and then, after (b), (c) Z-folding the first and second panels about the first and second fold lines to bring the second panel first face into operative contact with the fourth panel second face, and the first panel second face into operative contact with the second panel second face.

According to another aspect of the present invention a method of producing a mailer from an intermediate comprising a substantially quadrate cut sheet of paper having first and second faces, top and bottom edges substantially parallel to each other, and first and second side edges substantially perpendicular to the top and bottom edges and substantially parallel to each other; the top and bottom edges spaced a first distance, and the side edges spaced a second distance, less than the first distance; first and second lines of weakness formed in the sheet adjacent, but spaced from and substantially parallel to, the first and second side edges, respectively, to define first and second removable side margin portions; first, second and third fold lines formed in the sheet substantially parallel to the top and bottom edges, and defining the sheet into first, second, third and fourth panels, the first panel between the top edge and the first fold line, the second panel between the first and second fold lines, the third panel between the second and third fold lines, and the fourth panel between the bottom edge and the third fold line; and at least one pattern of adhesive in the side margins on both of the faces, the patterns for holding the sheet in a folded configuration as a mailer. The method comprises: (a) folding the fourth panel about the third fold line so that the first face of the fourth panel comes into operative contact with the first face of the third panel; and then (b) Z-folding the first and second panels about the first and second fold lines to bring the second panel first face into operative contact with the fourth panel second face, and the first panel second face into operative contact with the second panel second face.

Preferably the adhesive comprises pressure activated cohesive and the method further comprises (c) applying a pressure of at least one hundred pounds per lineal inch to the folded intermediate to form a sealed mailer. Also, the intermediate preferably further comprises tacking pressure activated cohesive patterns disposed substantially parallel to the top and bottom edges and positioned to hold the first panel second face to the second panel second face adjacent the top edge and the second fold line, and to hold the fourth panel second face to the second panel first face adjacent the first and third fold lines; and then the method further comprises practicing (c) to seal the tacking adhesive to further seal the formed mailer. The method also preferably further comprises imaging outgoing addressee indicia on the first panel first face, and simplex imaging, at substantially the same time as the outgoing addressee indicia, negotiable instrument indicia, including at least some indicia in common with the outgoing addressee indicia, on the fourth panel first face.

The invention also comprises a mailer produced according to any of the methods set forth above.

It is a primary object of the present invention to provide a secure mailer type business form (and intermediate) and method for the production thereof) which has minimal or no show through or see through, may be simplex printed, and is postal compatible. This and other objects of the invention will become clear from an inspection of the detailed description of the invention and from the appended claims.

DETAILED DESCRIPTION OF THE DRAWINGS

Figure 1:
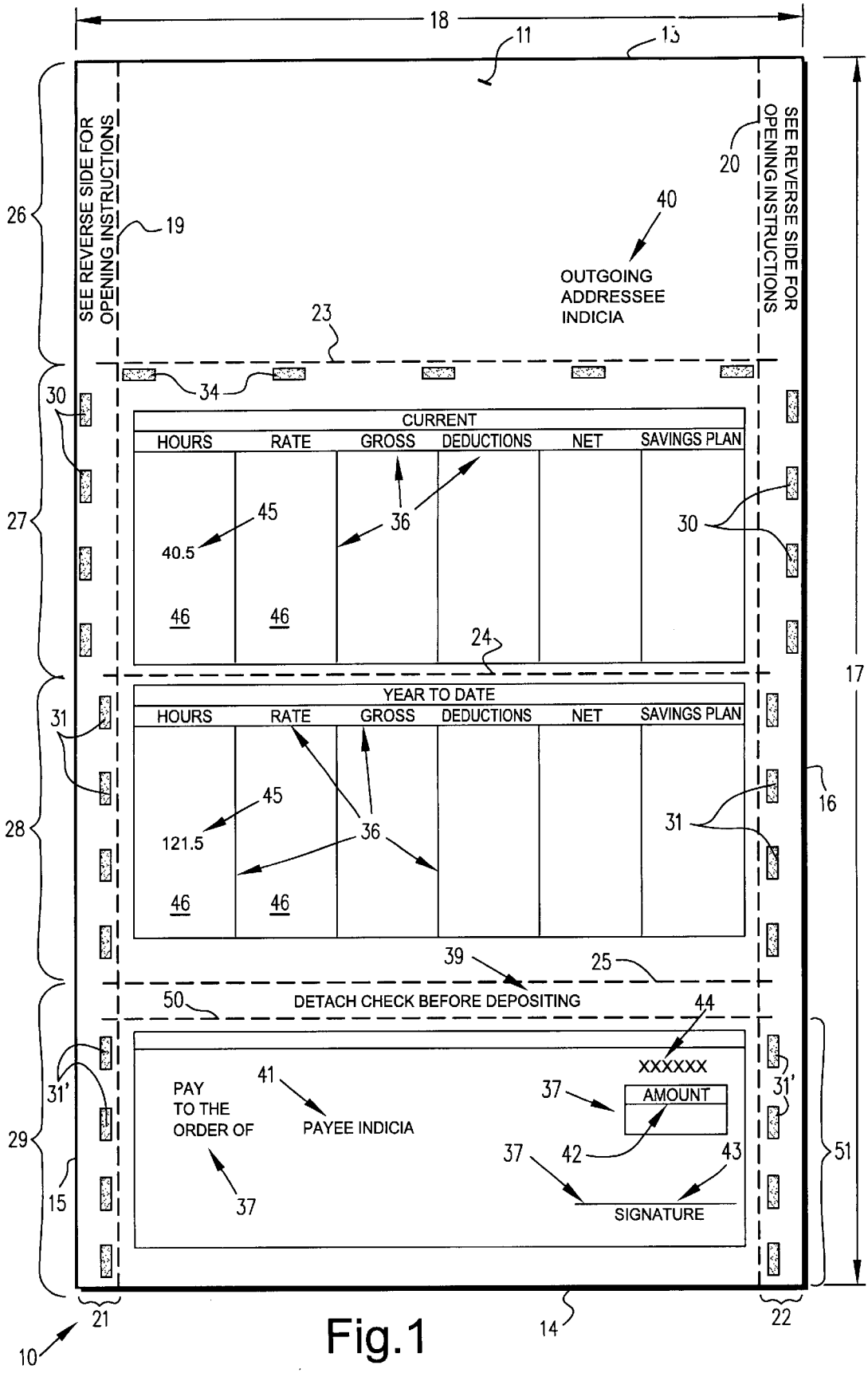
FIG. 1 is a top plan view of a first face of an exemplary mailer type business form intermediate according to the present invention.

FIG. 1 illustrates a mailer type business form intermediate shown generally by reference numeral 10 which comprises a substantially quadrate cut sheet of paper. The sheet of paper forming the intermediate 10 has a first face 11 seen in FIG. 1, and a second 12 (see FIG. 2) opposite the first face. The sheet of paper forming the intermediate 10 also has top and bottom edges 13, 14, respectively, substantially parallel to each other, and first and second side edges 15, 16, respectively, substantially parallel to each other and substantially perpendicular to the top and bottom edges 13, 14. The top and bottom edges 13, 14 are spaced a first distance 17 while the side edges 15, 16 are spaced a second distance 18, the distance 18 being less than the distance 17. According to a preferred embodiment of the present invention the distance 17 is equal to about fourteen inches. While the distance 18 (the width of the sheet of paper forming the intermediate 10) may vary, preferably it is preferably equal to about 8½ inches.

The intermediate 10 also comprises first and second lines of weakness 19, 20, respectively, such as perforation lines, formed in the sheet of paper adjacent, but spaced from, and substantially parallel to, the side edges 15, 16, respectively, to define first and second removable side margin portions 21, 22. The intermediate 10 has first, second and third fold lines 23, 24, 25, respectively, formed in the paper sheet and substantially parallel to the top and bottom edges 13, 14, and defining the intermediate 10 into four panels. Preferably, as illustrated, the panels are substantially the same size, although at least one of the panels can be of different size if desired. The first panel 26 is between the top edge 13 and first fold line 23, the second panel 27 is between the first and second fold lines 23, 24, the third panel 28 is between the third and fourth fold lines 24, 25, and the fourth panel 29 is between the third fold line and bottom edge 14.

Figure 5:
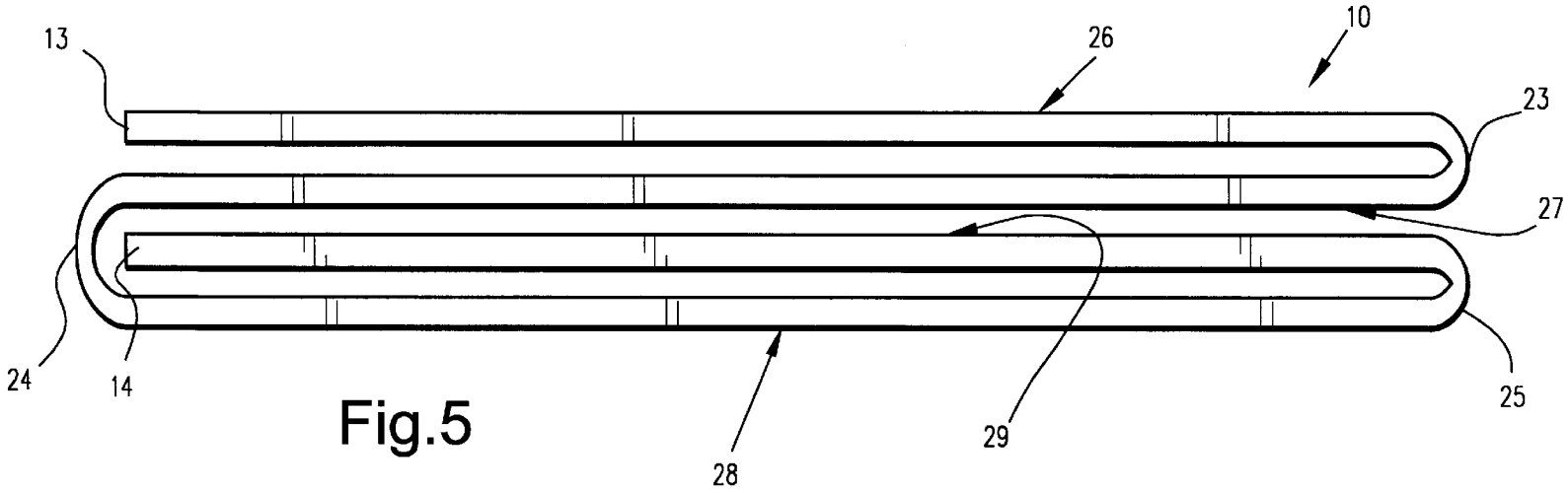
FIG. 5 is an end schematic view of the intermediate of FIG. 4 when completely folded.
Figure 6:
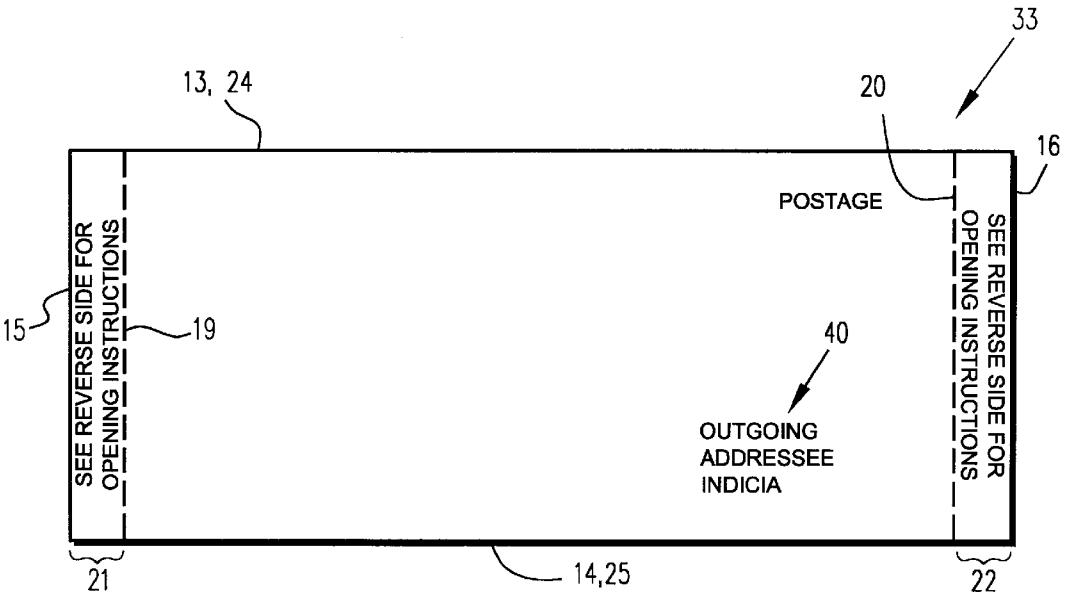
FIG. 6 is a top plan view of a sealed mailer made from the folded intermediate of FIG. 5.

At least one pattern of adhesive is provided in the side margins 21, 22 on both faces 11, 12, the patterns for holding the sheet of the intermediate 10 in a folded configuration as a mailer (see FIGS. 5 and 6). In the embodiment illustrated in the drawings the patterns—shown schematically at 30, 31, 31' on the first face 11 in the panels 27, 28, 29, respectively, and as 32, 32', and 30' in the panels 26, 27, and 29, respectively, in FIG. 2—are preferably patterns of pressure activated cohesive such as described in U.S. Pat. No. 5,201,464 (incorporated by reference herein). The patterns 30–32' may comprise any configuration such as lines, spots, dots, bars, strips, discontinuous or continuous, or any other suitable configuration. In the embodiment illustrated in the drawings the cohesive elements 30–32' are illustrated as discontinuous strips, being spaced close enough to each other to effectively completely seal the side edges 15, 16 of the intermediate when folded to form a final mailer 33 (see FIG. 6).

The intermediate 10 may also comprise tacking adhesive patterns for holding the longitudinal edges (comprising or parallel to the top and bottom edges 13, 14) of the intermediate together when folded to form the mailer 33 of FIG. 6. By "tacking" adhesive it is meant that the adhesive elements are constructed so that they do not provide a secure seal, but rather the panels which they hold together may be separated by sliding one's finger or an implement, between the panel portions held together by the packing adhesive, without significantly destroying the panels held together thereby. In the preferred embodiment illustrated, the tacking adhesive is also provided by pressure activated cohesive such as shown in U.S. Pat. No. 5,201,464, with discontinuous elements, widely spaced from each other. For example, as seen in FIG. 1, the tacking cohesive elements 34 (much more widely spaced than the elements 30, for example) are provided on the second panel 27 adjacent the first fold line 23, and are adapted to cooperate with the cohesive elements 34' (see FIG. 2) provided on the fourth panel 29 second face 12 adjacent the third fold line 25. The cohesive elements 35 are provided on the second face 12 of the first panel 26 adjacent the top edge 13 and are adapted to cooperate with the cohesive elements 35' provided on the second panel 27 second face 12 adjacent the second fold line 24.

Figure 2:
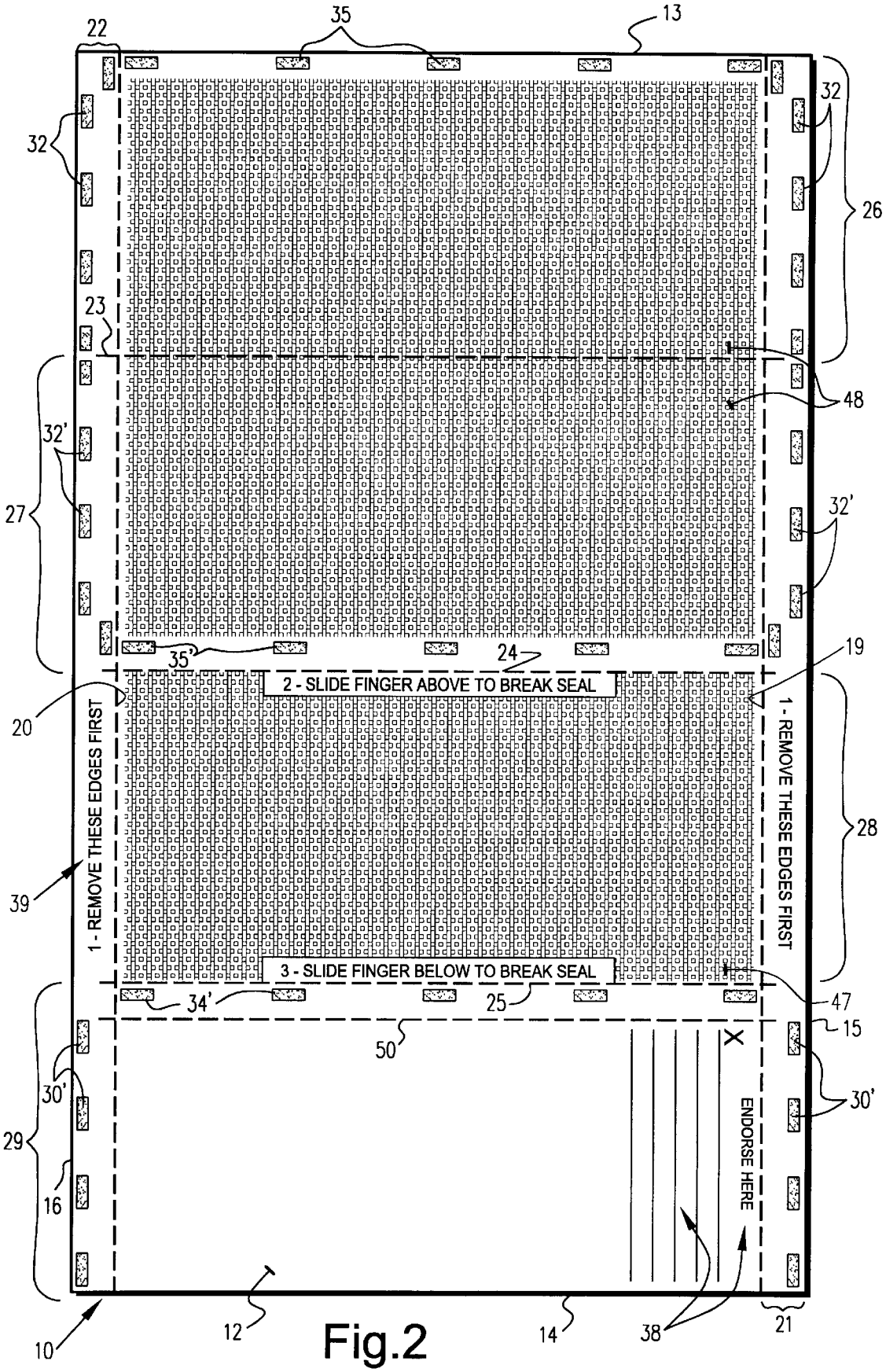
FIG. 2 is a top plan view of the second face of the intermediate of FIG. 1.

The intermediate 10 also preferably at some point in time has a wide variety of indicia imaged thereon. Non-variable indicia, such as the labeled columns 36 on the first face 11 of the panels 27, 28, and non-variable negotiable instrument indicia on the first face 11 of the fourth panel 29 as indicated by reference numeral 37 in FIG. 1, and other negotiable instrument non-variable indicia 38 on the second face 12 of the fourth panel 29 is illustrated in FIG. 2. Also, non-variable instruction indicia such as seen at 39 in FIGS. 1 and 2 is also preferably provided. However, also variable information is desirable simplex printed on the face 11 of the intermediate 10 including outgoing addressee indicia 40, payee indicia 41, and amount indicia 42 (as well as the printed signature and the check number at 43 and 44 in FIG. 1). Preferably at least part of the payee indicia 41 is in common with the outgoing addressee indicia 40, for example, a person's name. The person's name would appear in both the outgoing addressee indicia 40 as well as in the payee indicia 41. The person's address could also be provided at both 40, 41.

Various other variable indicia may also be simplex printed at substantially the same time that the indicia 40–43 is being printed within the columns 46, such as illustrated schematically at 45 in FIG. 1.

Also, according to the present invention, in order to substantially preclude, or at least minimize "show through" or "see through" of confidential indicia (including the indicia 41, 42, 45) within the mailer 33, security printing is provided on the second face 12. The security printing includes at least the security printing 47 on the second face 12 of the third panel 28, and additionally security printing 48 in at least one of (and preferably both of) the second face 12 of the panels 26, 27.

In the preferred embodiment, the fold lines 23–25 comprise lines of weakness, such as perforations. Also, preferably at least one additional line of weakness 50 is provided in the fourth panel 29 substantially parallel to the bottom edge 14 and adjacent the cohesive elements 34' (see FIG. 2). The line of weakness 50 insures that the tacking cohesive 34, 34' will not destroy any element of the negotiable instrument 51 that is defined in the fourth panel 29 between the lines of weakness 19, 20, and the line of weakness 50 and bottom edge 14. That way the integrity of the negotiable instrument 51 (which may be a bank check, as illustrated in the drawings, a money order, bearer bond, or the like) will not be compromised.

Figure 3:
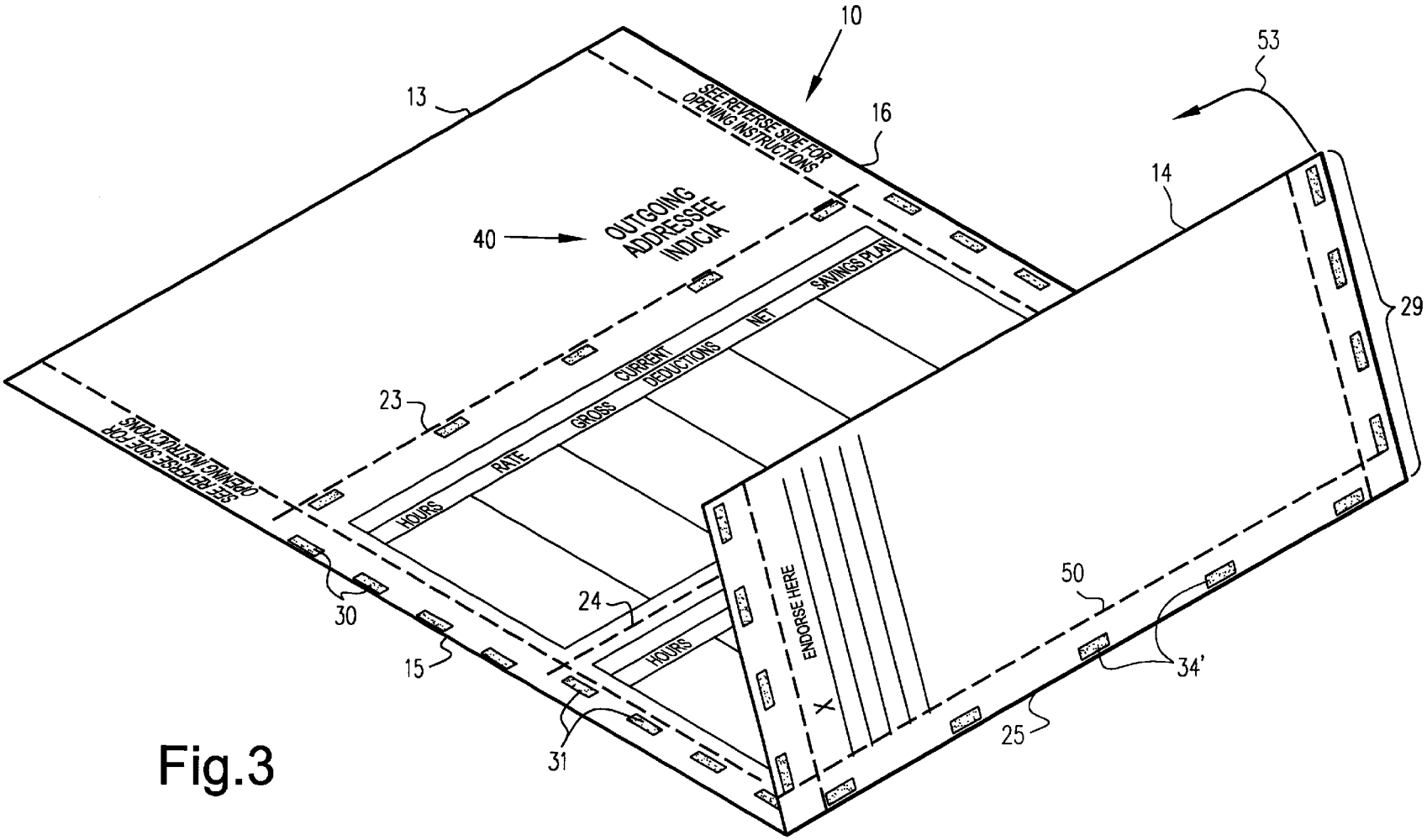
FIG. 3 is a perspective schematic view of the intermediate of FIGS. 1 and 2 having the fourth panel V-folded with respect to the third panel.
Figure 4:
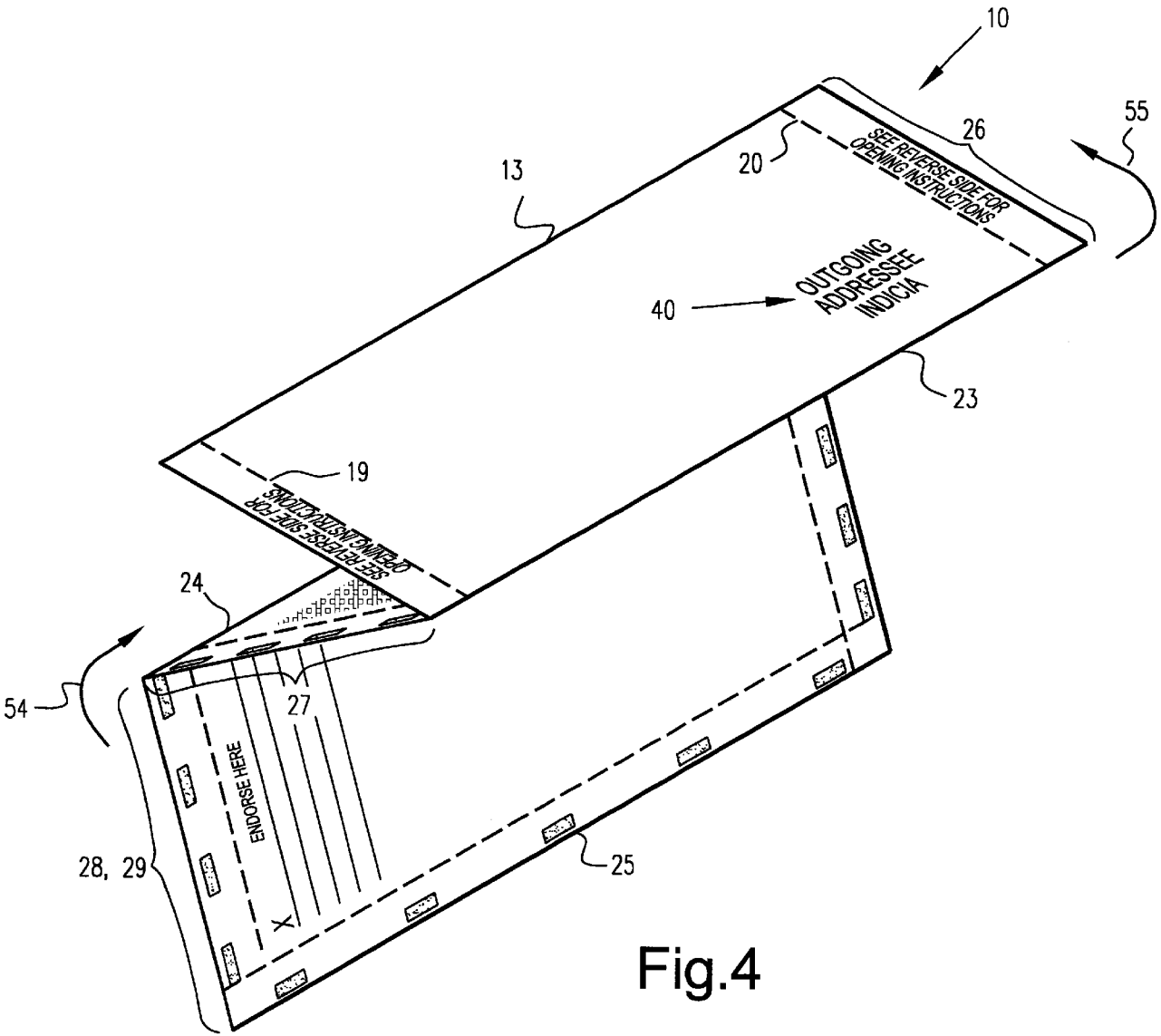
FIG. 4 is a view like that of FIG. 3 but showing the first and second panels Z-folded with respect to the third and fourth panels.

In the manner of construction of the mailer 33 from the intermediate 10, the variable indicia 40, 41, at least some of which is common, and 42 through 45, is imaged on the first face 11 of at least the first and fourth panels 26, 29 using a conventional simplex printer. Then either manually or utilizing conventional folding equipment, the fourth panel 29 is folded about the third fold line 25 so that the first face 11 of the fourth panel 29 comes into operative contact with the first face 11 of the third panel 28, the cohesive elements 31, 31' also coming into contact with each other. This folding action is seen by the arrow 53 in FIG. 3. Then, as seen by the arrows 54 and 55 in FIG. 4, the first and second panels 26, 27 are Z-folded about the first and second fold lines 23, 24 to bring the second panel 27 and first face 11 into operative contact with the fourth panel 29 second face 12, and the first panel 26 second face 12 into operative contact with the second panel 27 second face 12. This brings the cohesive elements 30, 30' into contact with each other, and the cohesive elements 32, 32' into contact with each other, the cohesive elements 34, 34' into contact with each other, and the cohesive elements 35, 35' into contact with each other. The completely folded intermediate is shown at 10 in FIG. 5, with the fourth panel 29 between the second and third panels 27, 28 and the first panel 26 on the top with the outgoing address indicia 40 on the outside. This four-ply construction, as well as at least the security printing 47 and preferably also the security printing 48, provides an outgoing mailer 33 that has substantially no, or minimum, "show through" or "see through" so that the confidential indicia thereon (e.g. 41–45) cannot be seen from the exterior of the mailer 33.

The final mailer 33 is produced by effecting sealing of the adhesive/cohesive elements. In the preferred embodiment where the adhesive/cohesive elements are pressure activated cohesive, the mailer 33 is passed through a conventional pressure sealer available from Moore North America of Banokburn, Ill. which applies a force of at least 100 pounds per lineal inch, preferably at least about 200 pounds per lineal inch. A steam roller construction of the sealer may be utilized unless an insert is provided in the mailer 33, in which case a conventional edge sealer should be utilized which substantially only engages the portions of the form 33 associated with or immediately above or below the cohesive elements 30–35'.

Figure 7:
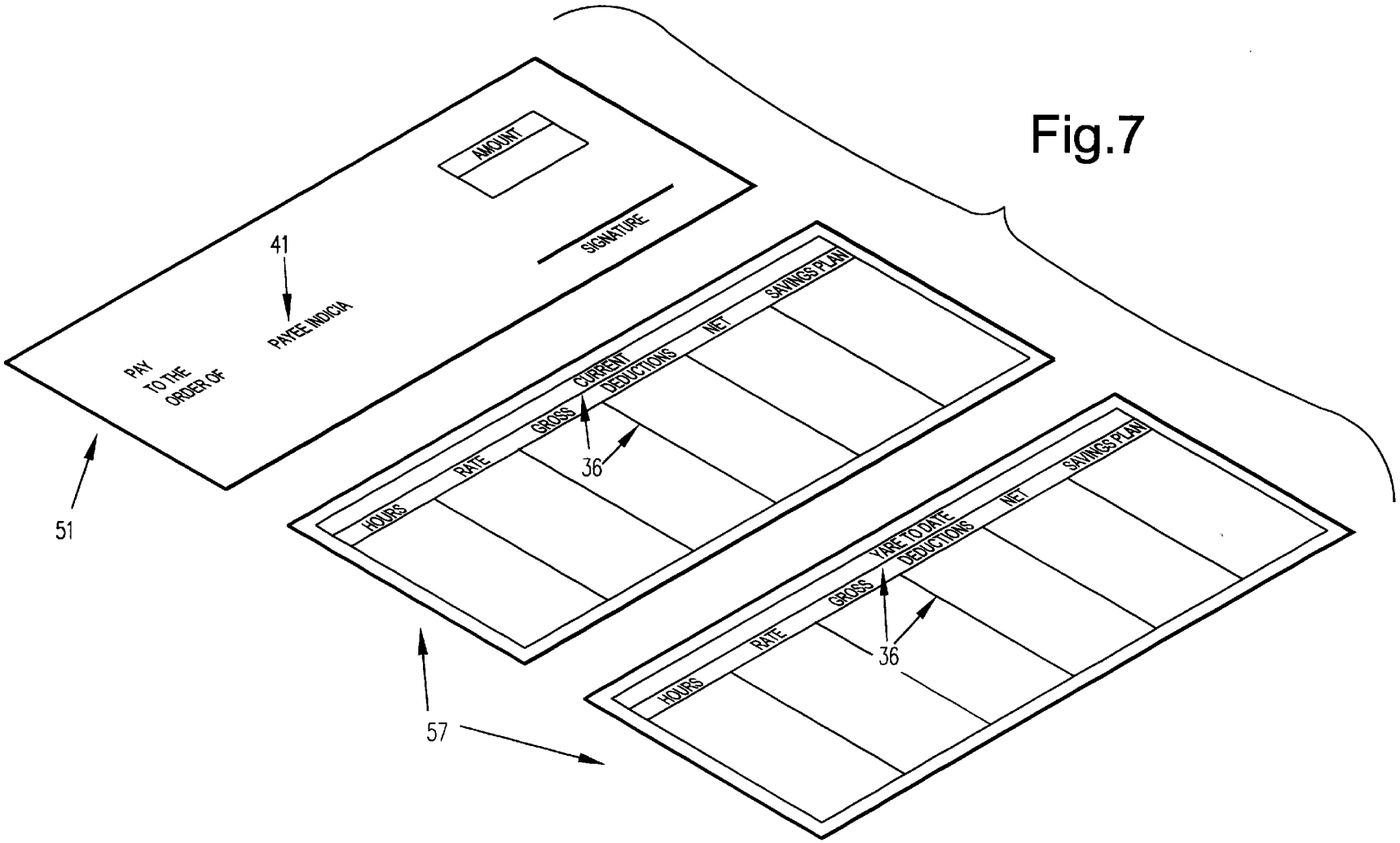
FIG. 7 shows the components of the final mailer of FIG. 6 after they are detached from the rest of the mailer, for use by the outgoing addressee.

The mailer 33 of FIG. 6 is then sent through the mails and when received by the outgoing addressee 40 is opened by first detaching the removable side margin portions 21, 22 by tearing along the perforation lines 19, 20, and then taking one's finger or an implement and sticking it between the panels 29, 28 to break the tacking seal provided by the tacking cohesive elements 34, 34' and by also sliding one's finger or an implement between the panels 26, 27 to break the tacking seal provided by the cohesive elements 35, 35'. The negotiable instrument 51 is also detached along the perforation line 50 from the rest of the form, and by detachment of the fold lines/lines of weakness 23–25 the elements 57 seen in FIG. 7 (which may comprise pay stubs or other information that the addressee may wish to keep) can be detached from each other and the rest of the form.

It will thus be seen that according to the present invention a highly advantageous intermediate for a mailer type business form, as well as a method of making a mailer from the intermediate, and the mailer so produced, have been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. A mailer type business form intermediate comprising:

a substantially quadrate cut sheet of paper having first and second faces, top and bottom edges substantially parallel to each other, and first and second side edges substantially perpendicular to said top and bottom edges and substantially parallel to each other;

said top and bottom edges spaced a first distance, and said side edges spaced a second distance, less than said first distance;

first and second lines of weakness formed in said sheet adjacent, but spaced from and substantially parallel to, said first and second side edges, respectively, to define first and second removable side margin portions;

first, second and third fold lines formed in said sheet substantially parallel to said top and bottom edges, and defining said sheet into first, second, third and fourth panels, said first panel between said top edge and said first fold line, said second panel between said first and second fold lines, said third panel between said second and third fold lines, and said fourth panel between said bottom edge and said third fold line;

at least one pattern of adhesive in said side margins on both of said faces, said patterns for holding said sheet in a folded configuration as a mailer;

said fourth panel comprising indicia defining a negotiable instrument; and tacking adhesive patterns disposed substantially parallel to said top and bottom edges and positioned to hold said first panel second face to said second panel second face adjacent said top edge and said second fold line, and to hold said fourth panel second face to said second panel first face adjacent said first and third fold lines, and wherein said panels are of substantially a same size.

2. An intermediate as recited in claim 1 wherein said at least one pattern of adhesive comprises pressure activated cohesive pattern elements in said removable side margin portions of said first face of said second, third, and fourth panels, and said second face of said first, second and fourth panels.

3. An intermediate as recited in claim 1 wherein said negotiable instrument defining indicia includes payee and amount indicia on said first face of said fourth panel.

4. An intermediate as recited in claim 1 further comprising a line of weakness separating said negotiable instrument from a remainder of said fourth panel, said line of weakness disposed on an opposite side of tacking adhesive on said fourth panel second face from said third fold line.

5. An intermediate as recited in claim 1 further comprising security screening on said third panel second face and on at least one of said first and second panel second faces.

6. An intermediate as recited in claim 1 wherein said at least one pattern of adhesive comprises pressure activated cohesive pattern elements in said removable side margin portions of said first face of said second, third, and fourth panels, and said second face of said first, second and fourth panels; wherein said negotiable instrument defining indicia includes payee and amount indicia on said first face of said fourth panel; and further comprising outgoing addressee indicia, corresponding at least in part to said payee indicia, imaged on said first panel first face.

7. An intermediate as recited in claim 2 wherein said negotiable instrument defining indicia is provided on both said first and second faces of said fourth panel.

8. An intermediate as recited in claim 3 further comprising outgoing addressee indicia, corresponding at least in part to said payee indicia, imaged on said first panel first face.

9. An intermediate as recited in claim 6 wherein said first, second and third fold lines are lines of weakness; and wherein the distance between said top and bottom edges is about 14 inches; and wherein the distance between said side edges is about 8½ inches.

10. A mailer type business form intermediate comprising:

a substantially quadrate cut sheet of paper having first and second faces, top and bottom edges substantially parallel to each other, and first and second side edges substantially perpendicular to said top and bottom edges and substantially parallel to each other;

said top and bottom edges spaced a first distance, and said side edges spaced a second distance, less than said first distance;

first and second lines of weakness formed in said sheet adjacent, but spaced from and substantially parallel to, said first and second side edges, respectively, to define first and second removable side margin portions;

first, second and third fold lines formed in said sheet substantially parallel to said top and bottom edges, and defining said sheet into first, second, third and fourth panels, said first panel between said top edge and said first fold line, said second panel between said first and second fold lines, said third panel between said second and third fold lines, and said fourth panel between said bottom edge and said third fold line;

at least one pattern of adhesive in said side margins on both of said faces, said patterns for holding said sheet in a folded configuration as a mailer; and tacking adhesive patterns disposed substantially parallel to said top and bottom edges and positioned to hold said first panel second face to said second panel second face adjacent said top edge and said second fold line, and to hold said fourth panel second face to said second panel first face adjacent said first and third fold lines, when said intermediate is folded about said fold lines.

11. An intermediate as recited in claim 10 wherein said tacking adhesive comprises widely spaced elements of pressure activated cohesive.

12. An intermediate as recited in claim 10 further comprising outgoing addressee indicia imaged on said first panel first face, and security screening on said first, second, and third panel second faces; and wherein said at least one pattern of adhesive comprises pressure activated cohesive pattern elements in said removable side margin portions of said first face of said second, third, and fourth panels, and said second face of said first, second and fourth panels.

13. An intermediate as recited in claim 11 wherein said tacking pressure activated cohesive comprises elements provided on said fourth panel second face adjacent said third fold line; and further comprising a line of weakness in said fourth panel substantially parallel to said third fold line and on an opposite side of said elements from said third fold line.

14. A mailer type business form intermediate comprising:

a substantially quadrate cut sheet of paper having first and second faces, top and bottom edges substantially parallel to each other, and first and second side edges substantially perpendicular to said top and bottom edges and substantially parallel to each other;

said top and bottom edges spaced a first distance, and said side edges spaced a second distance, less than said first distance;

first and second lines of weakness formed in said sheet adjacent, but spaced from and substantially parallel to, said first and second side edges, respectively, to define first and second removable side margin portions;

first, second and third fold lines formed in said sheet substantially parallel to said top and bottom edges, and defining said sheet into first, second, third and fourth panels, said first panel between said top edge and said first fold line, said second panel between said first and second fold lines, said third panel between said second and third fold lines, and said fourth panel between said bottom edge and said third fold line;

at least one pattern of adhesive in said side margins on both of said faces, said patterns for holding said sheet in a folded configuration as a mailer; and said fourth panel comprising indicia defining a negotiable instrument, wherein said at least one pattern of adhesive comprises pressure activated cohesive pattern elements in said removable side margin portions of said first face of said second, third, and fourth panels, and said second face of said first, second and fourth panels, and wherein said pressure activated cohesive pattern elements of said second face of said first and second panels are disposed to mutually engage and hold the second face of the first panel and the second face of the second panel in opposed facing relation, wherein the pressure activated cohesive pattern elements of the first face of the third and fourth panels are disposed to mutually engage and hold the first face of the fourth panel in opposed facing relation to the first face of the third panel, and wherein the pressure activated cohesive pattern elements on the second face of the fourth panel are complimentary to the adhesive patterns provided on the first face of the second panel to hold the second face of the fourth panel in opposed facing relation to the first face of the second panel on folding of the mailer.

* * * * *